US007507191B2

(12) United States Patent
Zachary

(10) Patent No.: US 7,507,191 B2
(45) **Date of Patent: *Mar. 24, 2009**

(54) DUAL ROTATION ROTARY TORSO EXERCISE BENCH

(76) Inventor: Kyriacos Mark Zachary, 819 W. Seminary Ave., Lutherville, MD (US) 21093

( * ) Notice: Subject to any disclaimer, the term of this patent is extended or adjusted under 35 U.S.C. 154(b) by 14 days.

This patent is subject to a terminal disclaimer.

(21) Appl. No.: 11/811,093

(22) Filed: Jun. 8, 2007

(65) Prior Publication Data

US 2007/0298946 A1 Dec. 27, 2007

Related U.S. Application Data

(63) Continuation-in-part of application No. 10/547,870, filed on Sep. 2, 2005, now Pat. No. 7,297,095.

(60) Provisional application No. 60/811,748, filed on Jun. 8, 2006.

(51) Int. Cl.
*A63B 26/00* (2006.01)

(52) U.S. Cl. ..... 482/142; 482/94

(58) Field of Classification Search ..... 482/142, 482/92–98; D21/676, 686, 690, 94–96
See application file for complete search history.

(56) References Cited

U.S. PATENT DOCUMENTS

| | | | | |
|---|---|---|---|---|
| 4,456,245 | A | 6/1984 | Baldwin | |
| 6,015,370 | A | 1/2000 | Pandozy | |
| 6,468,191 | B1 | 10/2002 | Cameron | |
| 6,575,884 | B1 | 6/2003 | Eazor | |
| 7,297,095 | B2 * | 11/2007 | Zachary | 482/142 |
| 7,318,795 | B2 * | 1/2008 | Dauterive | 482/148 |

* cited by examiner

*Primary Examiner*—Lori Amerson

(57) ABSTRACT

A novel method and device for exercising the rotary torso muscles of the human body, wherein the device is an exercise machine on which a user's body is supported in a generally supine position. The machine is comprised of a frame structure with a rotatable upper torso support (including a head and back rest), a rotatable lower torso support (including a seat) and feet stabilizing rollers, aligned longitudinally. The device further comprises a knee cushion for rotating the lower torso support and a peg upon a weight support arm for holding free weights that impart resistance against the rotation of the upper and lower torso supports. In an alternate embodiment, additional resistance to the rotation movement is provided by a belt mechanism which wraps around a disk connected to the axle of the upper torso support and up through the weight support arm upon which free weights are placed.

14 Claims, 5 Drawing Sheets

DUAL ROTATION ROTARY TORSO EXERCISE BENCH

CROSS-REFERENCE TO RELATED APPLICATION

The present application derives priority from U.S. provisional application No. 60/811,748 filed 08 Jun. 2006, and is a continuation-in-part of U.S. patent application Ser. No. 10/547,870 filed 02 Sep. 2005 now U.S. Pat. No. 7,297,095.

BACKGROUND OF THE INVENTION

1. Field of the Invention

The present invention generally relates to an exercise machine, and more particularly it relates to a dual rotation rotary torso exercise machine that simultaneously exercises both the upper and lower torso in a generally supine position.

2. Description of the Background

Exercise equipment designed to specifically focus on or isolate the abdominal muscles is well known in the art. However, such equipment does not provide for simultaneous isolated exercising of the upper and lower abdominal muscles through movement of the both the upper and lower torso. Examples of devices designed to target rotary torso muscles traditionally have an arrangement similar to that disclosed in U.S. Pat. No. 6,575,884 to Eazor; and U.S. Pat. No. 4,456,245 to Baldwin. Eazor '884 discloses an abdominal exercise machine that lifts both the upper and the lower torso up in the same direction, rather than rotating them in opposite directions to provide more a workout to the abdominal muscles. The Baldwin '245 rotary torso machine is configured so that a user's body is supported in a generally upright seated position, upper and lower torso portions are engaged so as to restrict movement of the user's body to rotary movement of the upper torso relative to the lower torso about an axis extending longitudinally of the user's body, and force (by means of weights in this instance) is imposed to resist such movement. In a seated position the hips are flexed such that the targeted muscles are necessarily slightly flexed and unable to reach maximum extension during the rotary torso exercises.

Applicant's own co-pending application 20060172869 discloses another variation that supports a user's body in a generally supine position with a fixed lower torso support and rotatable upper torso support, and a peg for holding free weights that impart resistance against the rotation of the upper torso support.

In virtually all apparatuses that offer this type of exercise, the arms and shoulders initiate the initial force of the rotation, instead of by the isolated action of the lower muscles themselves. Furthermore, much of the equipment designed to focus exercise effort on the abdominal muscles incorporates the weight of the user as resistance and cannot, therefore, be adjusted for incorporation into a resistance training program.

Ideally, rotary torso exercises should be performed with the hips at least partially extended in a generally supine position, so that the targeted oblique, rectus abdominus, and upper thigh muscles are able to reach maximum extended and flexed positions. Performing the exercise in a generally supine position with hips at least partially extended, vice sitting or standing, also reduces pressure and weight on the lower back and spine, allowing the user to work the targeted area without stress to other areas. In addition, the lower abdominal muscles should initiate the initial force of the rotation, instead of arms and upper torso. Moreover, the user should be able to selectively vary the resistance levels as well as the degrees and directions of rotation, in order to effectively target and condition specific muscles in the torso area.

In light of the foregoing, it would be advantageous over the prior art to provide a dual rotation rotary torso machine in which a user's body is supported in a generally supine position with hips at least partially extended with the upper and lower torso portions separately supported and engaged to rotate in opposite directions about an axis extending longitudinally of the user's body, and free weights are used to impose and to vary resistance to such movement. By moving both the upper and lower torso in opposite directions, the user will stretch and work out the abdominal muscles and at the same time, the user will feel less of a strain on his lower spine than if he were only to move his upper torso. This would be especially beneficial to patients during rehabilitative therapy as well as users who want to prevent any risk of back injury while exercising. Additionally it would be advantageous to provide a provide a belt mechanism, which provides added resistance and allows a more intense rotary torso workout for the user

SUMMARY OF THE INVENTION

It is, therefore, a primary object of the present invention to provide a dual rotation rotary torso device which rotates both the upper and lower torso of a user's body, and thereby reduces the risk of back injuries.

Another object of the present invention is provide a dual rotation rotary torso device which moves both the upper and lower torso in opposite directions, and thereby stretches and works out the user's abdominal muscles.

It is another object to provide a dual rotary torso device in which a user's body is supported in a generally supine position with hips at least partially extended and upper and lower torso portions separately supported to rotate in opposite directions about an axis extending longitudinally of the user's body, thereby working the abdominal muscles with less strain on the lower spine.

It is another object to provide a dual rotary torso device that relies on free weights supplemented by a belt-resistance system to vary resistance to such movement.

It is another object of the present invention to provide a dual rotation rotary torso device that is especially useful to a patient undergoing rehabilitative therapy.

Another object of the present invention is to provide a dual rotation rotary torso device that is particularly suited for commercial use in gyms and the like as it targets one muscle group.

These and other objects are accomplished by a novel method and apparatus for exercising the rotary torso muscles of the human body in a safe, efficient and accurate manner. The device is an exercise machine on which a user's body is supported in a generally supine position. The machine is comprised of a frame structure with a rotatable upper torso support (including a head and back rest), a rotatable lower torso support (including a seat) and feet stabilizing rollers, aligned longitudinally. The device further comprises a knee cushion for rotating the lower torso support and a peg upon a weight support arm for holding free weights that impart resistance against the rotation of the upper and lower torso supports. In an alternate embodiment, additional resistance to the rotation movement is provided by a belt mechanism which wraps around a disk connected to the axle of the upper torso support and up through the weight support arm upon which free weights are placed.

In use, the user's upper and lower torsos are engaged so as to restrict movement of the user's body to rotary movement of the upper torso relative to the lower torso about an axis extending longitudinally of the user's body, and force is imposed to resist such movement.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

The rotary torso exercise machine 100 of the present invention is essentially an exercise machine on which a user's body is supported in a generally supine position with hips at least partially extended with the upper and lower torso portions separately supported and engaged to rotate in opposite directions. A combination of free weights and belt-resistance is employed to vary resistance to such movement. By moving both the upper and lower torso in opposite directions, the user is able to stretch and work out the abdominal muscles. Moreover, this dual rotation from the supine position imposes less strain on the lower spine.

Figure 1:
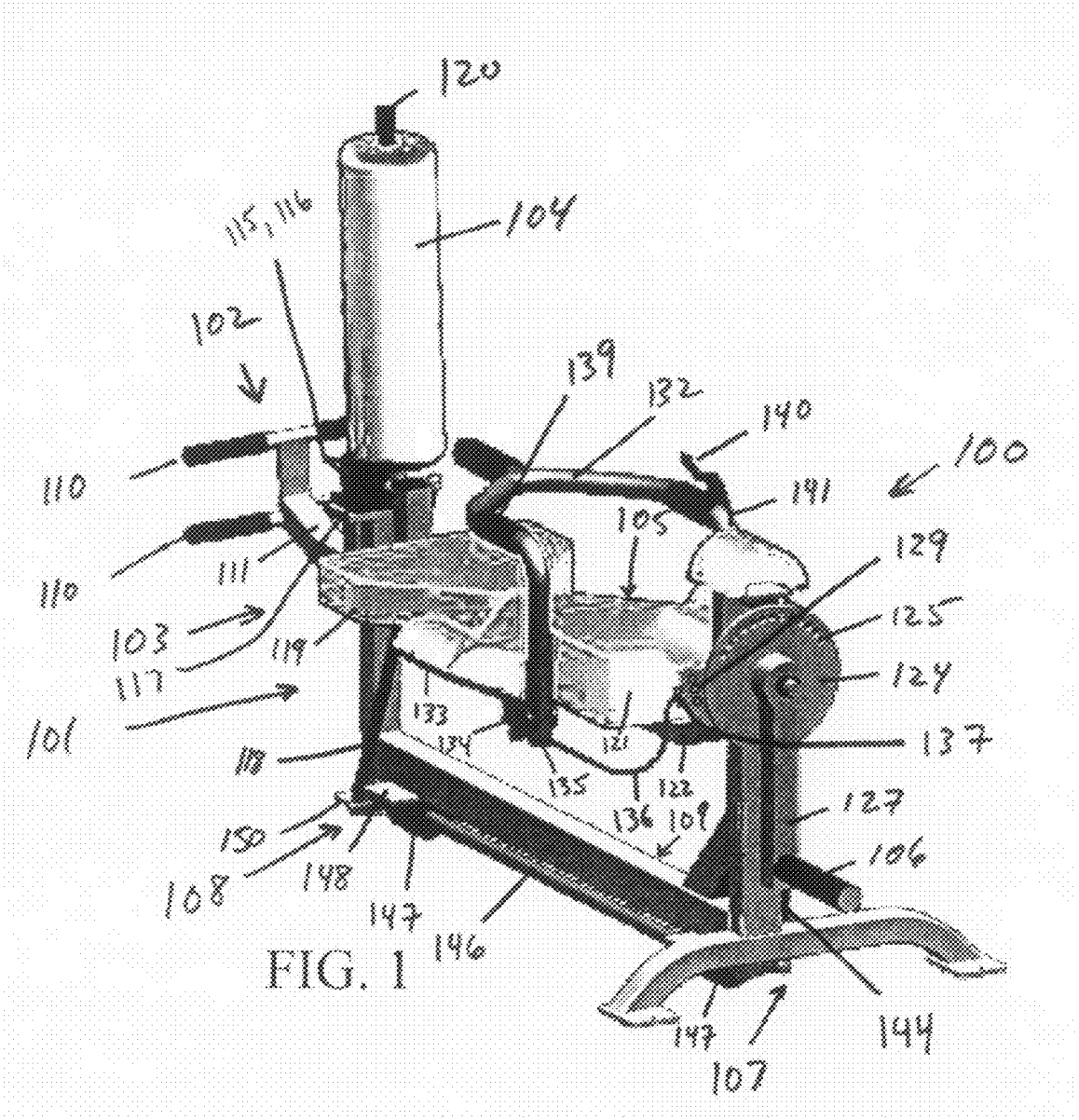
FIG. 1 is a front view drawing of the preferred embodiment of the rotary torso machine 100 of the present invention.
Figure 3:
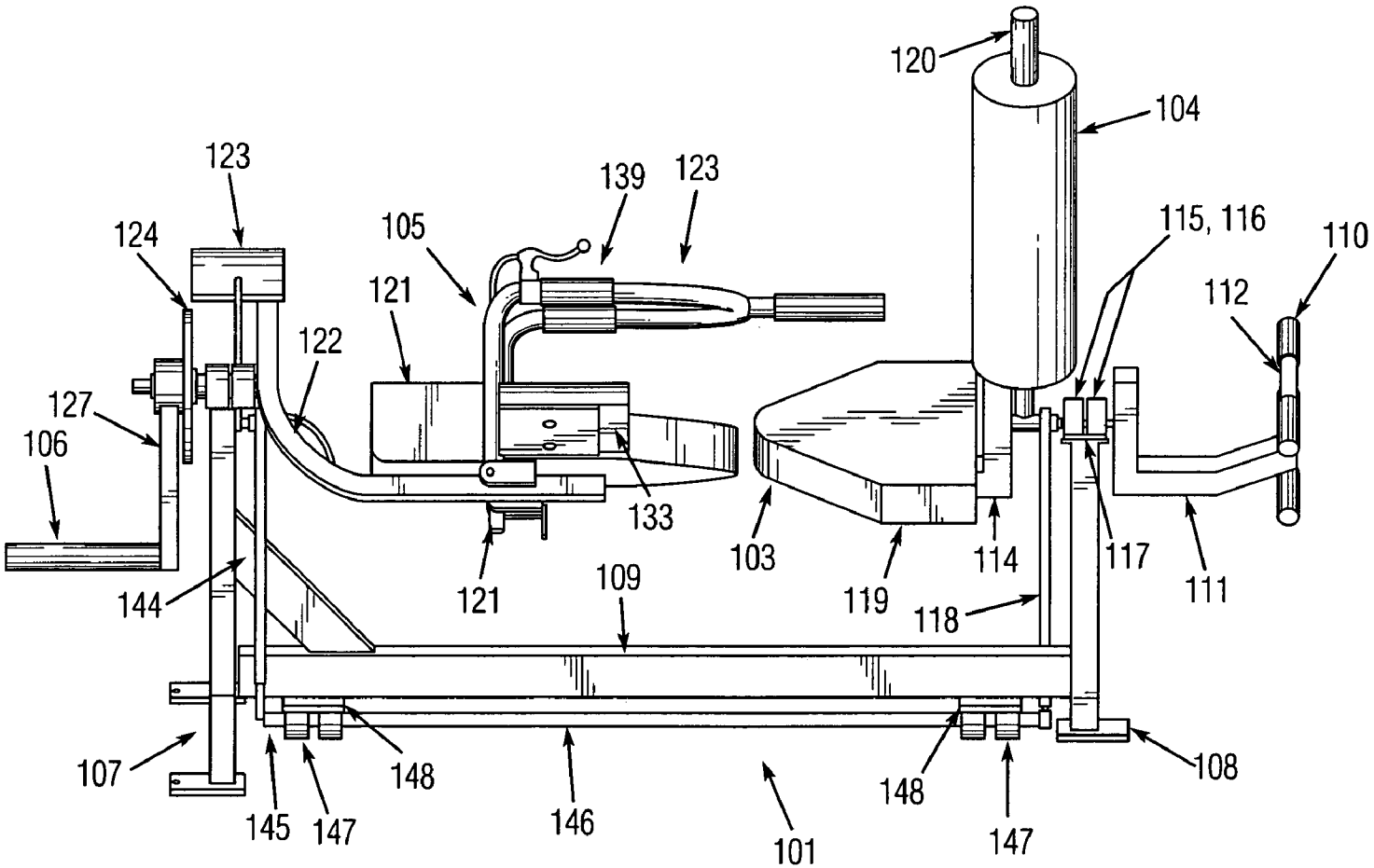
FIG. 3 is a side view drawing of a preferred embodiment of the present invention.

FIG. 1 is a front perspective view of a rotary torso machine 100, which includes six main features: (1) a freestanding frame 101, (2) a foot hold 102, (3) a rotatable lower torso support 103, (4) a fixed knee cushion 104 for rotating the lower torso support 103, (5) a rotatable upper torso support 105, and (6) a peg 106 for holding free weights that impart resistance against the rotation of the upper 105 and lower 103 torso supports. FIG. 3 is a side view drawing of a preferred embodiment, showing the upper torso support 105 and lower torso support 103 in opposite rotation.

In general use, a user lies with buttocks atop rotatable lower torso support 103 in a supine position with feet braced in foot hold 102 and knees straddling knee cushion 104, the upper torso atop upper torso support 105, and counter-rotates the upper and lower torso supports 103, 105 against the weight on peg 106.

The frame 101 serves as a supporting structure and is preferably made of commercial grade hollow 2" square steel tubing having a first end 107 and a second end 108, connected together by a center bar 109. However, those skilled in the art will recognize that other materials may be suitable for constructing the frame 101. The lower torso support 103 and foot hold 102 are pivotally connected to the frame 101 at the second end 108, and the upper torso support 105 is pivotally connected to the frame 101 at the first end 107, such that they maintain the position of the user's upper torso, lower, and feet, respectively, in a generally supine position along the longitudinal axis extending the length of the frame 101 from the first end 107 to the second end 108.

Figure 2:
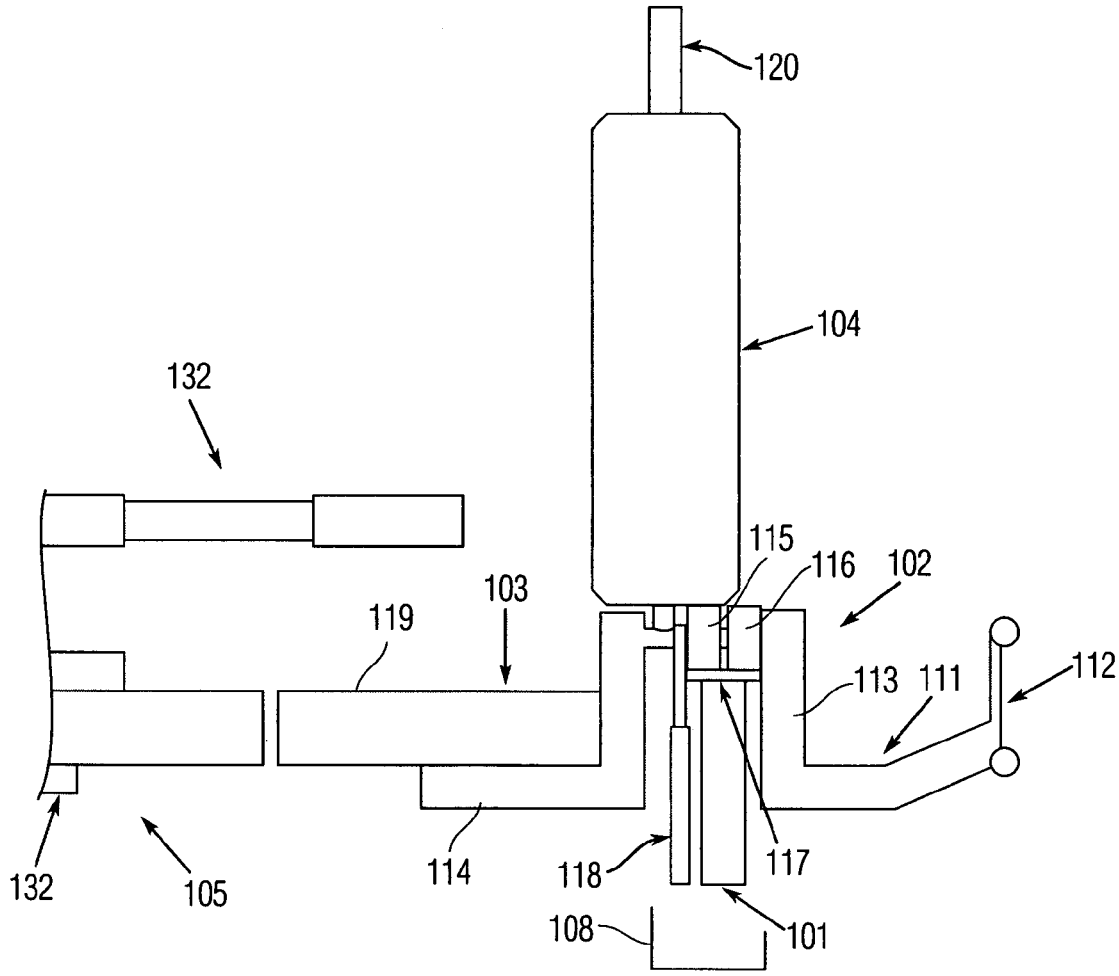
FIG. 2 is a side view drawing of the foot hold 102, knee cushion 104, and lower support bar 103.

FIG. 2 is a side-view of the foot hold 102, knee cushion 104, and lower torso support 103. The foot hold 102 may be formed an integral part of the frame 101, protruding from the second end 108 of the frame 101. The foot hold 102 includes a substantially U-shaped bar 111 having an outwardly extended vertical strut 112 supporting a pair of lateral rollers 110 (or alternatively, fixed lateral struts), the rollers 110 extending parallel at a spaced distance from each other. The rollers 110 (or fixed struts) are preferably wrapped in a foam cushion for comfort. The user may rest his feet as desired on rollers 110, the foot hold 102 as a whole serving to immobilize the user's feet during the exercise.

The lower torso support 103 is comprised of a lower torso support bar 114 that is integrally connected via an axle to the foot hold 102 at the second end 108 of the frame 101. One or more (here two) bearing blocks 115, 116 are welded/bolted to the upward extension of the second end 108 of the frame 101, and the axle is rotatably seated in the bearing blocks 115, 116, thereby pivotally connecting the foot hold 102 and lower torso support member 103 to the frame 101. The bearing blocks 115, 116 sit atop of a metal plate 117. A limiter 118 comprises a downwardly extending strut affixed to the axle between foot hold 102 and lower torso support bar 114 and extending to the frame 101. The limiter 118 rotates with the foot hold 102 and lower torso support bar 114 until it bears against the frame 101, thereby limiting the angle of rotation (effectively controlling the direction of rotation). A seat cushion 119 is screwed or otherwise attached to the lower torso support bar 114. The support bar 114 is ideally formed from the same hollow steel tubing as the frame 101.

The knee cushion 104 is a cylindrical cushion inserted onto a bar 120 which is welded at one end or otherwise attached to the axle between the foot hold 102 and lower torso support bar 114, adjacent the limiter 118. The knee cushion 104 likewise rotates with the foot hold 102 and lower torso support bar 114. The knee cushion 104 is preferably cylindrical as it allows a user to easily pin his knees around it and use it, together with feet stabilizing rollers 112, as leverage to rotate his lower torso along the longitudinal axis, in a direction opposite his upper torso.

Figure 5:
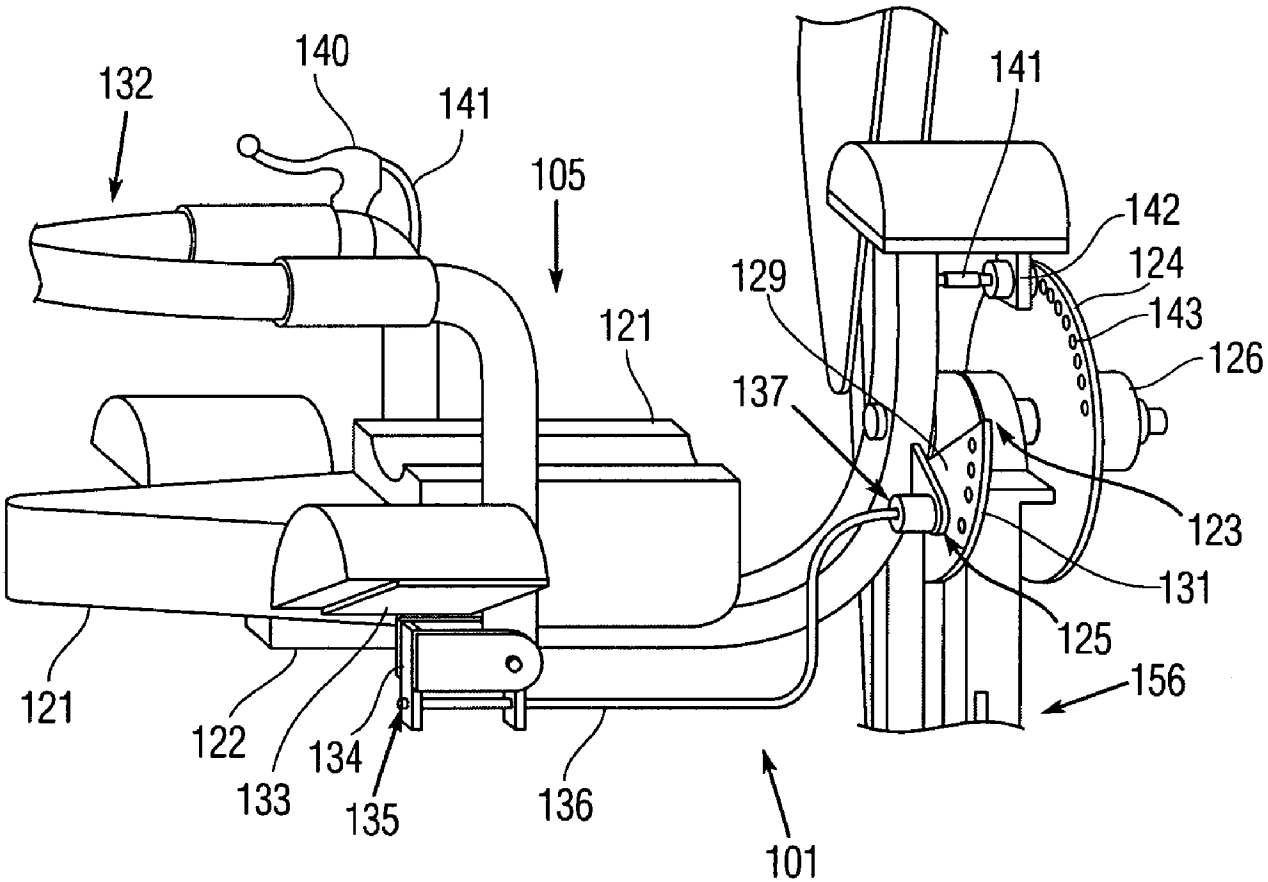
FIG. 5 is a side view drawing of the rotatable upper torso support 105.

With references to FIGS. 1, 3, and 5, the upper torso support 105 is designed to support the head, shoulders, upper torso, and arms of the user. Upper torso support 105 includes a number of cushions 121, which form the head/back rest and arm rests, all of which are attached to and supported by a rigid center support arm 122. The center support arm 122 of the upper torso support 105 is pivotally attached to the first end 107 of the frame 101. The preferred means of pivotal attachment of the center support arm 122 to the first end 107 includes a through bore (not shown) on the center support arm 122 for mounting it onto one end of an axle 123, such that it may rotate about the axle 123. The axle 123 is in turn mounted on bushings or bearings installed in a corresponding through-bore in the first end 107 of frame 101, or in a bearing block mounted atop first end 107 that extends along the longitudinal axis of the frame 101 (similar to the pivotal mounting of the foot hold 102 and lower torso support bar 114). The axle 123 extends past the frame 101 into a disk 124 having a number of holes 125 around its periphery. This disk 124 includes a cam 126 at the end, around which yet another support bar (weight support arm 127) is fixedly attached. The opposite end of weight support arm 127 has an attached protruding peg 106 for supporting free weights.

A semi-circular plate 129 is mounted on the axle 123, between the frame 101 and the disk 124. A key-holed peg 125 is attached to the frame 101 directly in front of the plate 129.

The plate 129 includes a number of holes 131 around its periphery, and the key-hole in the peg 125 lines ups with a hole 131. The semi-circular plate 129 operates in locking/unlocking the Y-shaped chest bar 132.

The upper torso support 105 further comprises a Y-shaped chest bar 132, which connects the cushions 121 to the center support arm 122. A cushion 121 is attached atop each of two upwardly curved plates 133, which are bolted to the center arm 122, with one plate 133 on each side of the arm 122. The cushions 121 atop each of the plates 133 form arm rests for the user. A hinge 134 connects each of the plates 133 to each of the ends of the Y-shaped bar 132. One plate 133 includes a hinge 134 connected to the bottom of the plate 133, wherein a pin 135 passes through the bottom of the hinge 134 and end of the bar 132, and that pin 135 is connected to a cable 136 with a spring-loaded pin mechanism 137 on the opposite end of it. The pin mechanism 137 will selectively engage and disengage the key-holed peg 125 and semi-circular plate 129. Pulling the chest bar 132 down releases the cable 136 and thereby selectively disengages the spring loaded pin mechanism 135 from the plate 129, allowing the center arm 122 to rotate about the axle 123 and thereby allows the user to exercise securely within the device 100 without the possibility of falling out. Pulling the chest bar 132 up, engages the pin 135 in a hole in the semi-circular plate 129 thereby fixing or locking the axle 123 and thus preventing the center arm 122 from rotating. This mechanism for locking the axle 123 when the chest bar 132 is raised prevents a user from operating the device 100 and attempting to exercise without being secured within the device 101 by the chest bar 132.

The Y-shaped chest bar 132 forms right and left side bars connected by a center bar, by which the user pulls the chest bar down over his chest. The right and left side bars include hand grips 139 on each side for providing the user with additional support and bracing during exercises. The Y-shaped bar 132 and the support arm 122 are ideally formed from the same hollow steel tubing as the frame 101.

Attached to a Y-shaped chest bar 132 (opposite the side with the hinge 134 described above) is a hand controlled actuator 140 connected to a cable 141. The cable 141 is in turn connected to a spring loaded pin mechanism 142 that is fixed to the center support arm 122 adjacent the axle 123. The disk 124 having a plurality of holes 143 adjacent its perimeter, engages the pin mechanism 142. Depressing and releasing the actuator 140 pulls and releases the cable 141, respectively, and thereby selectively disengages and engages (locks) the spring loaded pin 142 into disk 124. When the pin 142 is engaged in a hole 143, the support bar 122 is effectively fixed or locked to the axle 123, such that rotation of support bar 122 rotates the axle 123 meeting the resistance imparted by weights on arm 127. When the pin 142 is disengaged from a hole 143, the support bar 122 is free to rotate about the axle 123 in order to vary the position of the pin 142. Varying the position of the pin 142 engaged in the disk 124, varies the position of the upper torso support 105 relative to the position of the weight arm 127, thereby allowing the user to vary the degree of rotation about the user's longitudinal axis during which resistance is imparted as well as the direction of resistance.

A second limiter 144 is connected to the center support arm 122 and comprises a downwardly extending strut affixed to the center support arm 122 and extending to the frame 101 until it sits at a vertically spaced distance beneath the center bar 109. The limiter 144 rotates with the upper torso support 105 until it bears against the frame 101, thereby limiting the angle of rotation (effectively controlling the direction of rotation. This limiter 144 bears against a plate 145 which is screwed to a hollow bar 146 that is horizontally suspended at a spaced distance beneath the center bar 109 of the frame 101. This hollow bar 146 extends horizontally, underneath the center bar 109 of the frame 101. The hollow bar 146 passes through two bearing blocks 147, one at each end of the frame 101. The plate 148 sits above each bearing block 147.

Similarly, the bottom of the limiter 118 that forms part of the lower torso support assembly 103 extends vertically downward on the opposite side of the frame 101 and is screwed to a plate 150 which is screwed to the hollow bar 146 that is horizontally suspended at a spaced distance beneath the center bar 109 of the frame 101.

These combined plates 148, 150 and limiters 118, 144 permit the upper torso support assembly 105 and the lower torso support assembly 103 to only rotate in opposing directions.

The weight support arm 127 is further comprised of an optional stopping mechanism (i.e. peg or spring loaded peg mechanism), which may be engaged on either side of the frame 101 and when engaged prevents the weight support 127 from rotating beyond a predetermined angle relative to the frame 101 (i.e. stops the arm 127 at an angle of 25 degrees from perpendicular).

Both the lower torso seat 119 and the upper cushion 121 are triangular-shaped, thereby allowing users of various sizes (short and tall people) to slide forward and backward until they find their comfortable spot on the seat 119 and cushion 121, respectively.

In detailed operation, the user places free weights on weight peg 106. The user then sits on lower torso support seat 119, placing his feet in foot hold 102 and lying back onto upper to support 105. In the preferred position the lower back remains flat. The user then pulls the chest bar 132 over his chest. Holding the side of the chest bar 132, the user depresses actuator 140, rotates upper torso support 105 to the desired starting position, and releases actuator 140. The user then rotates his lower torso in the opposite direction and begins the rotation exercise against the resistance imparted by weights. In the illustrated embodiment the user can counter-rotate his upper and lower torso approximately 40 degrees to each side against the free-weight resistance (for a total of 80 degrees of rotation), thereby strengthening and exercising his rotary torso muscles.

Figure 4:
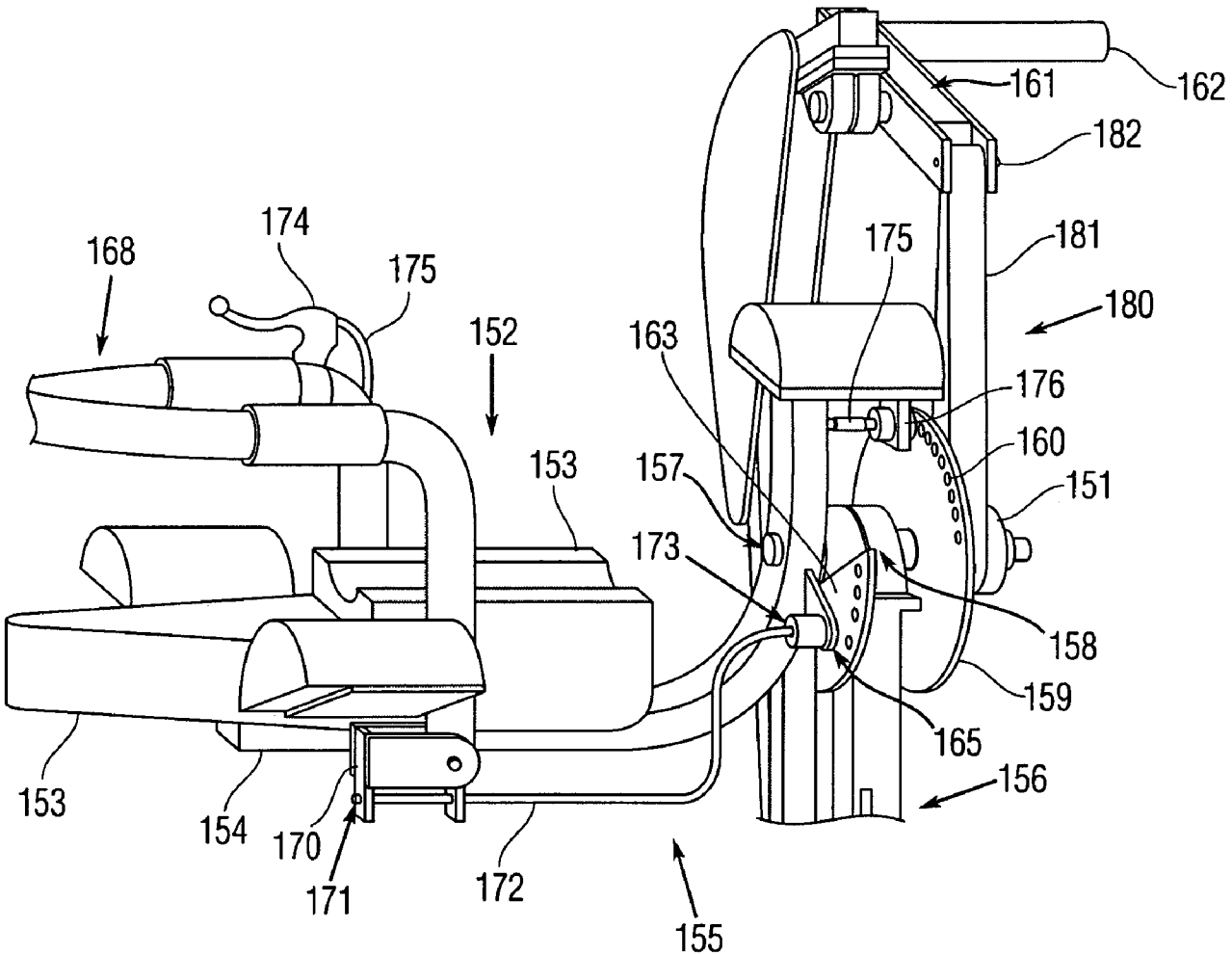
FIG. 4 is a side view drawing an alternate embodiment of the rotatable upper torso support 152, which includes a belt system 180 for providing added resistance.

FIG. 4 shows an alternate embodiment of the rotatable upper torso support 152, which includes a belt system 180 for providing added resistance.

The upper torso support 152 comprises a number of cushions 153, which form the head/back rest and arm rests, all of which are attached to and supported by a rigid center support arm 154. The center support arm 154 is rotatably attached to the first end 155 of the frame 156. The preferred means of rotatably attaching the center support arm 154 to the first end 155 includes a through bore 157 on the center support arm 154 for mounting it onto one end of an axle 158, such that it may rotate about the axle 158. The axle 158 is in turn mounted on bushings or bearings (not shown) installed either in a corresponding through-bore in the of the frame 156 or in a bearing block (not shown) mounted atop first end 155 that extends along the longitudinal axis of the frame 156. The axle 158 extends into another through-bore (not shown) of a disk 159 with a number of holes 160 around its periphery. This disk 159 includes a cam 151 at the end, around which a belt 181 is wrapped. The belt 181 extends up and wraps around a horizontal rod 182 built into the end of the weight support arm 161. The belt 181 is thin, flat, and about an inch wide. The belt 181 is clamped around the rod 182 and beneath the cam 151 to keep the belt 181 in place and prevent it from spinning around. The belt 181 provides added resistance to the weight support arm 161, which has an attached protruding peg 162 for supporting free weights (opposite the rod 182). Whichever direction the user rotates to, the arm 161 moves up and the one side of the belt tensions and the other side slacks.

A semi-circular plate 163 is mounted on the axle 158, between the frame 156 and the disk 159. A key-holed peg 165 is attached to the frame 156 directly in front of the plate 163, which includes a number of holes 166 around its periphery, and the key-hole in the peg 167 lines ups with a hole 166. The semi-circular plate 163 operates in locking/unlocking the Y-shaped chest bar 168, which connects the cushions 153 to the center support arm 154. A cushion 153 is attached atop each of two upwardly curved plates 169, which are bolted to the center arm 154, with one plate 164 on each side of the arm 154. The cushions 153 atop each of the plates 164 form arm rests for the user. A hinge 170 connects each of the plates 164 to each of the ends of the Y-shaped bar 168. One plate 164 includes a hinge 170 connected to the bottom of the plate 164, wherein a pin 171 passes through the bottom of the hinge 170 and end of the bar 168, and that pin 171 is connected to a cable 172 with a spring-loaded pin mechanism 173 on the opposite end of it. The pin mechanism 173 will selectively engage and disengage the key-holed peg 165 and semi-circular plate 163, when the bar 168 is pulled up and down, respectively.

Attached to a Y-shaped chest bar 168 (opposite the side with the hinge 170 described above) is a hand controlled actuator 174 connected to a cable 175. The cable 175 is in turn connected to a spring loaded pin mechanism 176 that is fixed to the center support arm 154 adjacent the axle 158. The disk 159 with a number of holes 160 adjacent its perimeter, engages the pin mechanism 142. Depressing and releasing the actuator 174 pulls and releases the cable 175, respectively, and thereby selectively disengages and engages (locks) the spring loaded pin 176 into disk 159. When the pin 176 is engaged in a hole, the support bar 154 is effectively fixed or locked to the axle 158, such that rotation of support bar 154 rotates the axle 158 meeting the resistance imparted by weights on arm 161. When the pin 142 is disengaged from a hole, the support bar, disk, and cam are free to rotate about the axle 158 and they thereby tension the belt on one side which pulls the weight arm 161 up in the air, creating resistance.

All of the other components of the present invention are described with reference to the first embodiment above.

In light of the foregoing, it should be apparent that the rotary torso machine 100 of the present invention provides a unique exercise machine for safely and effectively targeting the rotary torso muscles, and thus ideally suited for commercial use in gyms and the like. It should also be apparent that such a rotary torso machine 100 is ideally suited for use in homes, small gyms, clinics, hospitals, or the like. The configuration of the machine places the user in the best position for carrying out rotary torso exercises, namely generally supine with hips at least slightly extended and upper and lower torsos twisted in opposite directions. It further allows the user to vary the direction and degree of resistance imparted during the exercise.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. A rotary torso exercise machine, comprising:

a freestanding frame having an upwardly extended first end spaced from an upwardly extended second end and connected thereto by a center bar;

an upper torso support rotatably attached to the first end of said frame between said first end and said second end for supporting a user's upper torso in a supine position;

a lower torso support rotatably attached to the second end of said frame between said first end and said second end for supporting a user's lower torso in alignment with the upper torso in said supine position;

feet stabilizing struts attached to said lower torso support outside of said frame, and rotatable with said lower torso support for stabilizing the user's feet in said supine position; and a knee stabilizer attached to said lower torso support and rotatable therewith for allowing said user to straddle the knees thereabout while in said supine position to rotate said lower torso support.

2. The rotary torso exercise machine according to claim 1, further comprising free weights for imparting resistance.

3. The rotary torso exercise machine according to claim 2, wherein said free weights may be selectively attached to said upper torso support.

4. The rotary torso exercise machine according to claim 1, further comprising a belt for imparting resistance.

5. The rotary torso exercise machine according to claim 1, wherein said belt may be selectively attached to said upper torso support.

6. The rotary torso exercise machine according to claim 1, wherein said upper torso support further comprises a limiter for limiting rotation of said upper torso support to a direction opposite said lower support.

7. The rotary torso exercise machine according to claim 1, wherein said lower torso support further comprises a limiter for limiting rotation of said lower torso support to a direction opposite said upper torso support.

8. A rotary torso exercise machine according to claim 1, wherein said upper torso support comprises:

an axle mounted at said first end of said frame a center support arm supporting a plurality of cushions forming a head and back rest, wherein said center support arm is attached to said axle;

a chest bar attached to said center arm for locking said user within said upper torso support when said machine is in use; and a weight support arm attached on opposing side of said axle, wherein a peg is attached to said weight support arm for attaching free weights.

9. A rotary torso exercise machine according to claim 1, wherein said lower torso support comprises:

a lower torso support bar integrally connected to said foot hold at said second end of said frame; and a seat cushion attached atop said lower torso support bar.

10. A rotary torso exercise machine according to claim 1, wherein said lower torso support is integrally connected to said foot hold with an axle.

11. A rotary torso exercise machine according to claim 1, further comprising a chest bar locking mechanism comprising:

a cable attached to said chest bar, wherein said cable includes a pin mechanism at an end;

a plate including apertures mounted on said axle;

a peg having an aperture attached to said frame in front of said plate, whereby when said chest bar is pulled up, said pin mechanism will selectively engage said aperture in said peg and in said plate and when said chest bar is pulled down, said pin mechanism will selectively disengage said aperture in said peg and in said plate.

12. A rotary torso exercise machine, comprising:

a freestanding frame;

an upper torso support rotatably attached to a first end of said frame for supporting a user's upper torso in a supine position;

a lower torso support rotatably attached to a second end of said frame for supporting a user's lower torso in alignment with the upper torso in said supine position;

feet stabilizing struts attached to a second end of said frame for stabilizing the user's feet in said supine position; and, a peg connected, directly or indirectly, to said upper torso support, for holding free weights to impart resistance against rotation of said upper torso support.

13. The rotary torso exercise machine, according to claim 1, wherein said frame is comprised of hollow tubing.

14. The rotary torso exercise machine, according to claim 2, wherein said upper and lower torso supports further comprise cushioning for comfort.

* * * * *